US010903549B2

(12) United States Patent
Hu et al.

(10) Patent No.: US 10,903,549 B2
(45) Date of Patent: Jan. 26, 2021

(54) RECONFIGURABLE ANTENNA DEVICE SUITABLE FOR THREE-SEGMENT TYPE METAL BACK COVER

(71) Applicant: JRD Communication (Shenzhen) LTD., Shenzhen (CN)

(72) Inventors: Wei Hu, Shenzhen (CN); Chaoyu Tian, Shenzhen (CN)

(73) Assignee: JRD Communication (Shenzhen) LTD., Shenzhen (CN)

( * ) Notice: Subject to any disclaimer, the term of this patent is extended or adjusted under 35 U.S.C. 154(b) by 13 days.

(21) Appl. No.: 16/344,775

(22) PCT Filed: Sep. 1, 2017

(86) PCT No.: PCT/CN2017/100265

§ 371 (c)(1),
(2) Date: Apr. 24, 2019

(87) PCT Pub. No.: WO2018/076928

PCT Pub. Date: May 3, 2018

(65) Prior Publication Data

US 2019/0237853 A1 Aug. 1, 2019

(30) Foreign Application Priority Data

Oct. 26, 2016 (CN) ..... 2016 1 0942722

(51) Int. Cl.

| | |
|---|---|
| ***H01Q 1/24*** | (2006.01) |
| ***H01Q 1/50*** | (2006.01) |
| ***H01Q 5/307*** | (2015.01) |

(52) U.S. Cl.
CPC ..... *H01Q 1/243* (2013.01); *H01Q 1/242* (2013.01); *H01Q 1/50* (2013.01); *H01Q 5/307* (2015.01)

(58) Field of Classification Search
CPC ..... H01Q 1/243; H01Q 1/242; H01Q 1/50; H01Q 5/307; H01Q 1/48; H01Q 5/335; H01Q 5/328
See application file for complete search history.

(56) References Cited

U.S. PATENT DOCUMENTS

| | | | | |
|---|---|---|---|---|
| 9,484,631 | B1 * | 11/2016 | Napoles | H01Q 1/243 |
| 10,701,195 | B2 * | 6/2020 | Wang | H01Q 5/335 |

(Continued)

FOREIGN PATENT DOCUMENTS

| | | | |
|---|---|---|---|
| CN | 102368575 | A | 3/2012 |
| CN | 103700925 | A | 4/2014 |

(Continued)

*Primary Examiner* — Daniel D Chang

(57) ABSTRACT

A reconfigurable antenna device suitable for a three-segment metal back cover is provided. The antenna device may include an antenna radiation body, a first matching module, a second matching module, a switch module and a feeding end. The antenna radiation body cab be parallel to and above a first metal body and a second metal body of the metal back cover. The antenna radiation body can be grounded after being connected to the first matching module. The antenna radiation body is further connected to the second matching module, and the second matching module is connected to the feeding end and a switch module, respectively. A multi-band reconfigurable antenna can be achieved by adjusting the position of the switch module.

20 Claims, 1 Drawing Sheet

(56) References Cited

U.S. PATENT DOCUMENTS

| | | | | |
|---|---|---|---|---|
| 2013/0050038 | A1 | 2/2013 | Eom et al. | |
| 2016/0285151 | A1* | 9/2016 | Lee | H01Q 1/242 |
| 2018/0152208 | A1* | 5/2018 | Tsai | H01Q 5/35 |

FOREIGN PATENT DOCUMENTS

| | | | |
|---|---|---|---|
| CN | 105140626 | A | 12/2015 |
| CN | 105141717 | A | 12/2015 |
| CN | 106549213 | A | 3/2017 |

* cited by examiner

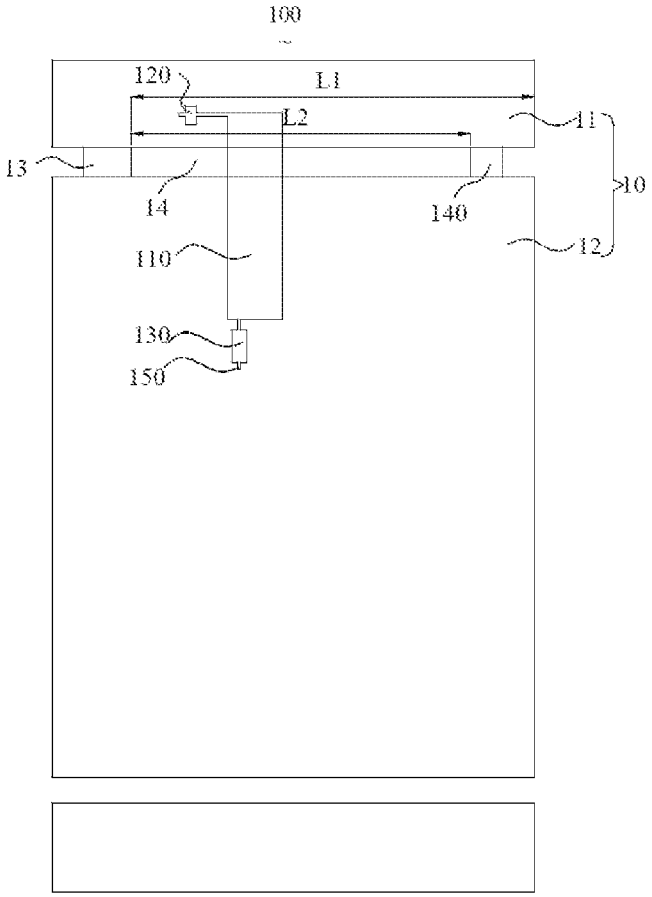
100
120
L1
L2
11
13
14
140
10
12
110
130
150

RECONFIGURABLE ANTENNA DEVICE SUITABLE FOR THREE-SEGMENT TYPE METAL BACK COVER

TECHNICAL FIELD

The present disclosure relates to the field of antennas, particularly relates to a reconfigurable antenna device suitable for a three-segment metal back cover.

BACKGROUND

At present, the metal body design of a mobile phone has advantages such as attractive metal gloss, outstanding high quality appearance and excellent structural stability compared with a traditional plastic body; however, the good electrical conductivity of a metal material can severely interfere the performance of the mobile phone antenna. Thus, the three-segment metal body design was utilized to solve the signal problem.

The three-segment metal integrated device body on the market basically has two major types. The first type is an all-metal body, in which a piece of metal is divided into three segments, and "strips" are arranged between the three segments for nano-injection or plastic filling. The other type is that a plastic material such as polycarbonate is used for the upper and lower segments, while the middle segment is made of metal. The antenna design of most three-segment metal bodies basically adopts one of the traditional antenna designs, such as IFA, LOOP, Monopole, and the like, which has technical problems of high structural design requirements and difficult debugging.

SUMMARY

The present disclosure provides a reconfigurable antenna device suitable for a three-segment metal back cover to solve the technical problems of a three-segment metal body that adopts the traditional antenna design in the prior art, such as high structural design requirements and difficult debugging.

In one aspect of the present disclosure, a reconfigurable antenna device suitable for a three-segment type metal back cover is provided. The antenna device includes an antenna radiation body, a first matching module, a second matching module, a switch module, and a feeding end.

In one embodiment, the antenna radiation body of metal back cover can be arranged parallel to and above a first metal body and a second metal body of the metal back cover, the antenna radiation body can be grounded after being connected to the first matching module, the antenna radiation body can be further configured to connect to the second matching module, the second matching module is respectively connected to the feeding end and the switch module, so as to achieve a multi-band reconfigurable antenna by adjusting and controlling the switch module.

In one embodiment, at least a portion of the first metal body and a portion of the second metal body of the metal back cover can be connected through a conductive material, and the conductive material serves as a ground end.

In one embodiment, the conductive material may be a printed circuit board (PCB), a flexible printed circuit (FPC) or a metal.

In one embodiment, a trench can be formed at a junction of the first metal body and the second metal body of the metal back cover, the switch module can be disposed on a main board PCB, the main board PCB can be respectively connected to the first metal body and the second metal body, and the switch module can be disposed in parallel above the trench.

In one embodiment, when the antenna device adjusts an initial resonant frequency, the position of the switch module is adjustable and is arranged away from the antenna radiation body; after the antenna device completes adjusting the initial resonant frequency, the position of the switch module can be fixed.

In one embodiment, the trench can be configured to be a dielectric member made of a non-conductive material.

In one embodiment, the width of the trench ranges from 1.5 to 3 mm.

In one embodiment, when the switch module is in an off state, the radiation length of the antenna device can be a first length, and the first length can be a distance from a ground end to a frame of the metal back cover; when the switch module is in an on state, the radiation length of the antenna device can be a second length, and the second length can be a distance from the ground end to the switch module.

In one embodiment, the first metal body and the second metal body can be arranged on the same plane.

In one embodiment, the parallel spacing distances from the antenna radiating body to the first metal body and the second metal body of the metal back cover are within a range of 0.5 to 2 mm.

The beneficial effects of the present disclosure are as follows: different from the prior art, the antenna device according to the present disclosure is provided with a switch module, and therefore by adjusting and controlling the position of the switch module, the design of a multi-band reconfigurable antenna can be realized; the antenna device has a novel structural design which is easy to operate, and the frequency modulation operation of the antenna is simple.

BRIEF DESCRIPTION OF THE DRAWINGS

In order to more clearly describe the technical solutions of the embodiments of the present disclosure, the drawings used in the description of the embodiments will be briefly described below. It is obvious that the drawings in the following description are only for some embodiments of the present invention. For a person of ordinary skill in the art, other drawings may also be obtained according to the drawings without any inventive skills. In the drawings:

FIG. 1 illustrates a schematic structural view of an embodiment of a reconfigurable antenna device suitable for a three-segment metal back cover according to the present disclosure.

DETAILED DESCRIPTION

The technical solutions of the embodiments of the present invention will be clearly and completely described in the following with reference to the accompanying drawings of the embodiments of the present disclosure. It is obvious that the described embodiments are only some embodiments, and not all of the embodiments of the present disclosure. Other embodiments may be obtained by a person of ordinary skill in the art based on the embodiments of the present disclosure without inventive skills, which should be within the scope of the present disclosure.

FIG. 1 illustrates a schematic structural view of an embodiment of a reconfigurable antenna device suitable for a three-segment metal back cover according to the present disclosure.

As shown in FIG. 1, the antenna device 100 includes an antenna radiation body 110, a first matching module 120, a second matching module 130, a switch module 140, and a feeding end 150.

The metal back cover 10 in this embodiment may include three segments of metal. The antenna device 100 of the present disclosure relates only to a first metal body 11 and a second metal body 12 of the metal back cover 10, where the third metal body is not involved in the technical points of the present disclosure, and thus will not be described in detail herein.

In one embodiment the antenna radiation body 110 can be disposed in parallel with the first metal body 11 and the second metal body 12 of the metal back cover 10, and the antenna radiation body 110 can be grounded through the first matching module 120, in which the first matching module 120 can be connected to the grounding end of a main board PCB (not shown), or the first matching module 120 may be connected to the first metal body 11 to be grounded. The antenna radiation body 110 can be further connected to the second matching module 130, and the second matching module 130 can be connected to the switch module 140 and the feeding end 150 respectively. The second matching module 130 can be connected to the switch module 140 through the main board PCB (not shown), so as to achieve a multi-band reconfigurable antenna by adjusting and controlling the switch module 140.

The antenna device 100 according to the present disclosure is provided with a switch module 140, and therefore by adjusting and controlling the position of the switch module 140, the design of a multi-band reconfigurable antenna can be realized; the antenna device 100 has a novel structural design which is easy to operate, and the frequency modulation operation of the antenna is simple.

The antenna radiation body 110 can be disposed in parallel above the first metal body 11 and the second metal body 12 of the metal back cover 10. In one embodiment, the first metal body 11 and the second metal body 12 of the metal back cover 10 can be disposed on the same plane, that is, the parallel spacing distances from the antenna radiation body 110 to the first metal body 11 and the second metal body 12 are equal. In one embodiment, the parallel spacing distances from the antenna radiation body 110 to the first metal body 11 and the second metal body 12 of the metal back cover 10 can be within a range of 0.5 to 2 mm. In one embodiment, the parallel spacing distances from the antenna radiation body 110 to the first metal body 11 and the second metal body 12 of the metal back cover 10 can be within a range of 0.8 to 1.2 mm. In one embodiment, the parallel spacing distances from the antenna radiation body 110 to the first metal body 11 and the second metal body 12 of the metal back cover 10 can be 1 mm. Therefore, there is a gap between the antenna radiation body 110 and the first metal body 11, and between the antenna radiation body and the second metal body 12 of the metal back cover 10; the gap may be provided with a support member for the antenna radiation body 110, or may be provided with other electronic components. In addition, these electronic components do not affect the normal operation of the antenna device 100, thereby improving the space utilization of the mobile terminal.

In one embodiment, at least a portion of the first metal body 11 and the second metal body 12 of the metal back cover 10 may be connected through a conductive material 13, and the conductive material 13 serves as a ground end. The conductive material 13 may be a printed circuit board (PCB), a flexible printed circuit (FPC), or a metal material. In this embodiment, the conductive material 13 is typically located inside the mobile terminal, and the mobile terminal still has a three-segment metal body when viewed from the outside.

In one embodiment, a junction between the first metal body 11 and the second metal body 12 of the metal back cover 10 may be provided with a trench 14. The switch module 140 can be disposed on the main board PCB, the switch module 140 can be electrically connected to the second matching module 130 through the main board PCB. The main board PCB can be respectively connected to the first metal body 11 and the second metal body 12, the switch module 140 can be disposed in parallel above the trench 14, and the switch module 140 can also be in direct contact with the trench 14.

In one embodiment, the trench 14 may be filled with a non-conductive material to become a dielectric member, such as a nano-injection material, a polycarbonate plastic material, and the like, wherein the width of the trench ranges from 1.5 to 3 mm; further, the width of the trench ranges from 1.8 to 2.5 mm; even further, the width of the trench is 2 mm. In addition, the wider the width of the trench is, the higher the efficiency of the antenna has.

In one embodiment, the switch module 140 may be disposed away from the antenna radiation body 110. When the antenna device 100 of the present disclosure adjusts the initial resonant frequency, the position of the switch module 140 is adjustable, and during a tuning process, the position of the switch module 140 can be adjusted to make the antenna device 100 to obtain a resonant frequency that meets predetermined requirements. After the antenna device 100 finishes adjusting the initial resonant frequency, the position of the switch module 140 can be set to be a fixed value.

In one embodiment, when the switch module 140 is in an Off state, the radiation length of the antenna device 100 can be a first length L1, and the first length L1 is the distance from the ground end 13 to a frame of the metal back cover 10. When the switch module 140 is in an On state, the radiation length of the antenna device 100 can be a second length L2, and the second length L2 is the distance from the ground terminal 13 to the switch module 140.

In one embodiment, when the switch module 140 is in the Off state, the antenna device 100 can be regarded as an edge-opened Slot antenna whose basic resonant frequency operates at about a quarter of the wavelength, which is determined by the first length L1. First, by adjusting the first matching module 120, the impedance matching of the low frequency can be adjusted accordingly, and a low frequency resonance of 700 to 960 M can be obtained, and on the basis of the foregoing, resonance can be further achieved between 2300 and 2700 M through three times the frequency multiplication; next, by further adjusting the second matching module 130, the present disclosure is able to adjust or switch to various frequency bands needed.

In one embodiment, when the switch module 140 is in the working state (i.e. On state), the edge opening of the antenna device 100 is short-circuited, and its basic resonant frequency operates at about one-half of the wavelength, which is determined by the second length L2. When the initial resonant frequency is first adjusted, the position of the switch module 140 is adjustable; after the initial resonant frequency has been adjusted, the position of the switch module 140 can be fixed, and the resonance between the intermediate frequencies of 1710 to 2170 M can be generated; further the resonance can be adjusted to the required frequency band by the second matching module 130. Therefore, the antenna device 100 can operate in three frequency bands of 700 to 960 M, 1710 to 2170 M, and 2300 to 2700 M.

A person of ordinary skill in the art can easily understand that the antenna device according to the present disclosure is provided with a switch module, and therefore by adjusting the position of the switch module, the design of a multi-band reconfigurable antenna can be realized; the antenna device has a novel structural design which is easy to operate, and the frequency modulation operation of the antenna is simple. In addition, since the antenna device of the present disclosure can be disposed on the metal back cover with a certain space therebetween, the corresponding portable mobile terminal can be provided with certain components therein, which facilitates the placement of internal components of the mobile terminal. It is also helpful for the miniaturization of a mobile terminal.

The above only describes certain embodiments of the present invention, which are not intended to limit the scope of the present invention, any equivalent structural changes or equivalent process changes based on the contents disclosed in the description or drawings of the present invention, or any direct or indirect application of the present invention in other related fields, are within the scope of protection of the present invention.

The invention claimed is:

1. A reconfigurable antenna device for a three-segment metal back cover, comprising:

an antenna radiation body;

a first matching module;

a second matching module;

a switch module; and a feeding end, wherein the antenna radiation body is arranged parallel to and above a first metal body and a second metal body of the metal back cover, the antenna radiation body is grounded after being connected to the first matching module, the antenna radiation body is further configured to connect to the second matching module, the second matching module is respectively connected to the feeding end and the switch module, so as to achieve a multi-band reconfigurable antenna by adjusting and controlling the switch module, wherein at least a portion of the first metal body and a portion of the second metal body of the metal back cover are connected through a conductive material, and the conductive material serves as a ground end, and wherein the first metal body and the second metal body are arranged on the same plane.

2. The antenna device according to claim 1, wherein the conductive material is a printed circuit board (PCB), a flexible printed circuit (FPC) or a metal.

3. The antenna device according to claim 2, wherein a trench is formed at a junction of the first metal body and the second metal body of the metal back cover, the switch module is disposed on a main board PCB, the main board PCB is respectively connected to the first metal body and the second metal body, and the switch module is disposed in parallel above the trench.

4. The antenna device according to claim 3, wherein when the antenna device is configured to adjust an initial resonant frequency, a position of the switch module is adjustable and is arranged away from the antenna radiation body; after the antenna device completes adjusting the initial resonant frequency, the position of the switch module is fixed.

5. The antenna device according to claim 3, wherein the trench comprises a dielectric member made of a non-conductive material.

6. The antenna device according to claim 3, wherein a width of the trench ranges from 1.5 to 3 mm.

7. The antenna device according to claim 3, wherein when the switch module is in an Off state, a radiation length of the antenna device is a first length, and the first length is a distance from the ground end to a frame of the metal back cover; when the switch module is in an On state, the radiation length of the antenna device is a second length, and the second length is a distance from the ground end to the switch module.

8. The antenna device according to claim 1, wherein the parallel spacing distances from the antenna radiating body to the first metal body and the second metal body of the metal back cover are within a range of 0.5 to 2 mm.

9. A reconfigurable antenna device for a three-segment metal back cover, comprising:

an antenna radiation body;

a first matching module;

a second matching module;

a switch module; and a feeding end, wherein the antenna radiation body is arranged parallel to and above a first metal body and a second metal body of the metal back cover, the antenna radiation body is grounded after being connected to the first matching module, the antenna radiation body is further configured to connect to the second matching module, the second matching module is respectively connected to the feeding end and the switch module, so as to achieve a multi-band reconfigurable antenna by adjusting and controlling the switch module;

wherein at least a portion of the first metal body and a portion of the second metal body of the metal back cover are connected through a conductive material, and the conductive material serves as a ground end, wherein the conductive material is a printed circuit board (PCB), a flexible printed circuit (FPC) or a metal, wherein a trench is formed at a junction of the first metal body and the second metal body of the metal back cover, the switch module is disposed on a main board PCB, the main board PCB is respectively connected to the first metal body and the second metal body, and the switch module is disposed in parallel above the trench, wherein when the antenna device adjusts an initial resonant frequency, a position of the switch module is adjustable and is arranged away from the antenna radiation body; after the antenna device completes adjusting the initial resonant frequency, the position of the switch module is fixed, wherein the trench comprises a dielectric member made of a non-conductive material, a width of the trench ranges from 1.5 to 3 mm, and wherein when the switch module is in an Off state, a radiation length of the antenna device is a first length, and the first length is a distance from the ground end to a frame of the metal back cover; when the switch module is in an On state, the radiation length of the antenna device is a second length, and the second length is a distance from the ground end to the switch module.

10. The antenna device according to claim 9, wherein the first metal body and the second metal body are arranged on the same plane.

11. A reconfigurable antenna device for a three-segment metal back cover, comprising:

an antenna radiation body;

a first matching module;

a second matching module;

a switch module; and a feeding end, wherein the antenna radiation body is arranged parallel to and above a first metal body and a second metal body of the metal back cover, the antenna radiation body is grounded after being connected to the first matching module, the antenna radiation body is further configured to connect to the second matching module, the second matching module is respectively connected to the feeding end and the switch module, so as to achieve a multi-band reconfigurable antenna by adjusting and controlling the switch module; and wherein a trench is formed at a junction of the first metal body and the second metal body of the metal back cover.

12. The antenna device according to claim 11, wherein at least a portion of the first metal body and a portion of the second metal body of the metal back cover are connected through a conductive material, and the conductive material serves as a ground end.

13. The antenna device according to claim 12, wherein the conductive material is a printed circuit board (PCB), a flexible printed circuit (FPC) or a metal.

14. The antenna device according to claim 13, wherein the switch module is disposed on a main board PCB, the main board PCB is respectively connected to the first metal body and the second metal body, and the switch module is disposed in parallel above the trench.

15. The antenna device according to claim 14, wherein when the antenna device adjusts an initial resonant frequency, a position of the switch module is adjustable and is arranged away from the antenna radiation body; after the antenna device completes adjusting the initial resonant frequency, the position of the switch module is fixed.

16. The antenna device according to claim 14, wherein the trench comprises a dielectric member made of a non-conductive material.

17. The antenna device according to claim 14, wherein a width of the trench ranges from 1.5 to 3 mm.

18. The antenna device according to claim 14, wherein when the switch module is in an Off state, a radiation length of the antenna device is a first length, and the first length is a distance from a ground end to a frame of the metal back cover; when the switch module is in an On state, the radiation length of the antenna device is a second length, and the second length is a distance from the ground end to the switch module.

19. The antenna device according to claim 11, wherein the first metal body and the second metal body are arranged on the same plane.

20. The antenna device according to claim 19, wherein parallel spacing distances from the antenna radiating body to the first metal body and the second metal body of the metal back cover are within a range of 0.5 to 2 mm.

* * * * *